US006585186B1

(12) United States Patent
Räty

(10) Patent No.: US 6,585,186 B1
(45) Date of Patent: Jul. 1, 2003

(54) METHOD IN REELING OF A PAPER OR PAPERBOARD WEB AND REEL-UP FOR A PAPER OR PAPERBOARD WEB

(75) Inventor: Jarkko Räty, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/701,263

(22) PCT Filed: May 27, 1999

(86) PCT No.: PCT/FI99/00453

§ 371 (c)(1),
(2), (4) Date: Nov. 27, 2000

(87) PCT Pub. No.: WO99/61360

PCT Pub. Date: Dec. 2, 1999

(30) Foreign Application Priority Data

May 27, 1998 (FI) ..... 981182

(51) Int. Cl.[7] ..... B65H 18/08
(52) U.S. Cl. ..... 242/531; 242/531.1
(58) Field of Search ..... 242/531, 531.1, 242/542.4, 542.3

(56) References Cited

U.S. PATENT DOCUMENTS

| | | | | | |
|---|---|---|---|---|---|
| 3,383,064 | A | * | 5/1968 | Daly et al. | 242/542.1 |
| 3,658,272 | A | * | 4/1972 | Bennett et al. | 242/541.7 |
| 3,792,820 | A | * | 2/1974 | Lucas | 242/541.7 |
| 3,813,053 | A | * | 5/1974 | Butler, Jr. et al. | 242/412.3 |
| 3,869,095 | A | | 3/1975 | Diltz | |
| 4,360,170 | A | * | 11/1982 | Kuklies et al. | 242/527 |
| 4,508,279 | A | | 4/1985 | Tokuno et al. | |
| 4,634,068 | A | | 1/1987 | Malkki et al. | |
| 4,697,755 | A | | 10/1987 | Kataoka | |
| 4,905,925 | A | | 3/1990 | Kremar | |
| 4,932,599 | A | * | 6/1990 | Doerfel | 242/530.4 |
| 4,944,476 | A | | 7/1990 | Olson | |
| 5,226,611 | A | * | 7/1993 | Butterworth et al. | 242/527 |
| 5,251,835 | A | | 10/1993 | Kyytsonen | |
| 5,360,179 | A | | 11/1994 | Vesterinen et al. | |
| 5,393,008 | A | | 2/1995 | Kyytsonen et al. | |
| 5,593,106 | A | * | 1/1997 | Cavanagh | 242/527 |
| 5,695,149 | A | * | 12/1997 | Schulze et al. | 242/533.4 |
| 5,713,534 | A | * | 2/1998 | McClenathan et al. | 242/527.1 |
| 5,909,856 | A | * | 6/1999 | Myer et al. | 242/530 |
| 5,988,557 | A | * | 11/1999 | Moller et al. | 242/532 |

FOREIGN PATENT DOCUMENTS

| | | |
|---|---|---|
| EP | 0161372 | 11/1985 |
| EP | 0483093 | 1/1993 |
| EP | 0616965 | 9/1994 |
| EP | 0739695 | 10/1996 |
| EP | 0697006 | 6/1997 |
| WO | 9534495 | 12/1995 |

* cited by examiner

*Primary Examiner*—Donald P. Walsh
*Assistant Examiner*—Joseph C. Rodriguez
(74) *Attorney, Agent, or Firm*—Steinberg & Raskin, P.C.

(57) ABSTRACT

In the method in reeling of a paper or paperboard web, a web (W) is guided by means of a reeling cylinder (1) onto a reel (R) to be formed around a reeling axle (2). There are at least two reeling cylinders (1), both of which are used to reel in turn the web (W) onto the corresponding reel. The reels (R) are formed in turn in reeling stations located on opposite sides of the pair of reeling cylinders (1). The web (W) travels between the reeling cylinders (1) to either reeling cylinder (1) and the corresponding reel (R).

32 Claims, 8 Drawing Sheets

METHOD IN REELING OF A PAPER OR PAPERBOARD WEB AND REEL-UP FOR A PAPER OR PAPERBOARD WEB

FIELD OF THE INVENTION

The invention relates to a method in reeling of a paper or paperboard web, in which the web is guided by means of a reeling cylinder or a corresponding device guiding the web onto the reel to be formed around a reeling axle, wherein there are at least two reeling axles or the like, both of which are used in turn to reel the web onto the corresponding reel. The invention also relates to a reel-up for a paper or paperboard web.

BACKGROUND OF THE INVENTION

In the final end of a paper or paperboard machine or in a finishing apparatus such as a coater for paper or paperboard, a continuous fibrous web coming from the preceding sections is reeled around a rotating reeling axle, i.e. a reel spool, to form a reel, i.e. a so-called machine reel. The reeling is conducted by means of a reeling cylinder rotating at the web speed, via which reeling cylinder the web enters the reel. Between the reeling cylinder and the reel, a loading is maintained, which causes a predetermined linear load in a reeling nip located in the contact point of the reel and the reeling cylinder approximately parallel to the reeling axle. Typically, the loading is effected by applying a load to the reel by means of a loading mechanism connected to the ends of the reeling axle towards the stationary reeling cylinder mounted in the frame of the reel-up at the same time when the reeling axle, supported by the ends, moves further apart from the reeling cylinder along with the growth of the reel. The above-described reel-up type is called a Pope-reel. In these reel-ups it is possible to implement the rotating of the reeling axle and the reel with a surface drive, wherein the reeling axle rotates freely in the support structures of the reel-up, and the force required for rotation is transmitted from the reeling cylinder via the reeling nip to the reel, or with a centre-drive, wherein not only the reeling cylinder but also the reeling axle is provided with a drive.

The reel-up type operating with the surface drive is presented e.g. in the Finnish patent 71107 and in the related U.S. Pat. No. 4,634,068. A centre-drive assisted reel-up is disclosed e.g. in the Finnish patent application 905284 by the applicant and in the related U.S. Pat. No. 5,251,835. A centre-drive assisted reel-up which is provided separately with a loading mechanism for the reel and a transfer mechanism for the reel, is disclosed in the European patent 604558 and in the related U.S. Pat. No. 5,393,008.

Because a continuous web is passed from the preceding sections of the paper or paperboard machine or after treatment apparatus of the web at the running speed of the machine or apparatus, a reel change has to be conducted at intervals, i.e. when the reel to be reeled in the reeling station becomes full, the web is cut with a suitable method, which depends e.g. on the grammage of the web, and the new end of the web following the cutting point is guided around a new empty reeling axle, which is brought to the change station from a storage of reeling axles, i.e. from a so-called reel spool storage. The change sequence which is conducted at high web speeds is the most sensitive part of the reeling process, and it involves the transfer of the reeling axle from the reel spool storage to the change position into a change connection with the web travelling onto the reel being completed, the acceleration of the reeling axle to the web speed, cutting of the web in such a way that the web is cut at a desired moment and at a desired point of the reel-up geometry and its guidance immediately around the empty reeling axle, as well as the deceleration and stopping of the full reel of several tonnes in weight after the cutting of the web. There are numerous patents and patent applications related to this change sequence or a part thereof, and as examples reference can be made to the Finnish patent 95683 of the applicant and the related international publication WO 95/34495 (member pressing the web to prevent access of air to the web), to the Finnish application 915432 of the applicant and the related U.S. Pat. No. 5,360,179 (cutting of the web by means of a water jet) and to the Finnish patent 97339 by the applicant and the related EP application publication 739695 (striking blade cutting device for cutting the web with a full-width cut).

The reel spool storage from which the reeling axles are transferred to the change position before initiating the change, is typically located on horizontal rails. The rails are typically located in the travel direction of the web before the reel to be reeled and they end approximately above the reeling cylinder, from which point the first reeling axle is always lowered down to a device for initial reeling by means of lowering arms, as presented e.g. in the U.S. Pat. No. 4,944,467. The U.S. Pat. No. 4,905,925 discloses a reel spool storage in which the reeling axles are placed on rails above the reeling rails supporting the reel in the reeling station, from which position they are lowered downwards along inclined rails to the device for initial reeling in contact with the web travelling on the periphery of the reeling cylinder. The reel spool storage can also be integrated on the reeling rails.

Typically, the reeling cylinder has a stationary position in the frame of the reel-up. However, a solution for a reel-up is also known where the one in which the reeling cylinder is arranged in the frame to move in the vertical direction and to be loaded against the reel, whose position is arranged adjustable on the reeling rails. The solution, which is disclosed in the European patent 697006, enables moving the reeling axles along a straight path from the reel spool storage onto the reeling rails over the reeling cylinder, as well as the fixed position of the reeling axle during the reeling by compensating for the growth of the reel with the downward motion of the reeling cylinder. The European application publication 792829 discloses a reel in which the reeling cylinder to be loaded against the reel is capable of moving in the horizontal direction when the size of the reel grows and the reeling axle is rotating in stationary position.

Consequently, there are numerous known reel-up concepts. A common feature for all the above-mentioned reel-ups is either a stationary reeling cylinder or a moving reeling cylinder and a growing machine reel which is in nip contact therewith and on which reel the web running from the continuous production process or aftertreatment process of paper or paperboard is reeled. In particular, all reel-up concepts share the accurate and demanding change sequence to be effected by means of the reeling cylinder and the empty reeling axle brought in connection with the same. An undisturbed implementation of the change sequence to avoid broke sets high demands on the actuators and automatics, especially at current high web speeds which normally exceed 20 m/s, usually even 25 m/s.

In present centre-drive assisted reel-ups the change is typically implemented in such a way that during the initial reeling when the empty reeling axle has been accelerated to the web speed in the device for initial reeling, the empty reeling axle is in contact with the web travelling via the reeling cylinder, the web travelling via the reeling nip to the reel that is being completed. The reeling nip is opened by moving the reel being completed away from the reeling cylinder and the reeling axle is moved e.g. by means of the device for initial reeling into the change position between the reeling cylinder and the reel being completed, typically in such a way that after the nip between the reeling axle and the reeling cylinder the web travels a short distance on the periphery of the reeling axle and departs therefrom towards the reel. The web is cut after the exit point and guided immediately around the empty reeling axle, and thereafter it is possible to start to decelerate the full reel. The empty reeling axle, around which the web has started to accumulate, is changed when necessary from the device for initial reeling under the load of the loading devices in the reeling station, i.e. to a so-called secondary reeling, and at the same time the centre-drive of the reeling station is connected to the reeling axle. The discontinuity points in the aforementioned change sequence, involving e.g. the act of opening the reeling nip and the stopping of a complete reel at the full reel and the change from the initial reeling to the secondary reeling at the new reel, are, despite of all the technical improvements and precautions, difficult to control and may cause reeling flaws especially in the bottom and surface layers of the reel.

The European patent 483093 discloses, as one alternative, a reel-up in which two reeling cylinders and the corresponding reeling rails are placed on top of each other in such a way that the web can be guided via the upper reeling cylinder to the upper reeling station when the machine reel in the lower reeling station has become full. The path utilized in the change of the web to the upper reeling cylinder is long in the vertical direction, and the reeling cylinders and reeling rails superimposed at the same location in the longitudinal direction of the machine occupy space in the height direction.

OBJECTS AND SUMMARY OF THE INVENTION

The purpose of the invention is to present an improvement for the prior art in continuous reeling-up, and to present a method and a reel-up in which the change sequence in particular can be implemented in a controlled manner, but which also introduces new possibilities for the implementation of the structure of the reel-up and for the production of the reels. To attain this purpose, the method according to the invention is primarily characterized in that the reels are formed in turn in reeling stations located on the opposite sides of a pair of web guiding devices, such as reeling cylinders. When the first reeling cylinder and the corresponding first reeling station are utilized to form a reel, the other one can be free, and if desired, the web can be changed to travel to the other reeling cylinder and onto the reel located in the corresponding second reeling station. A particular advantage of the invention is that the reel that has become full after the reel change as well as the reeling cylinder via which it has been reeled, can be treated in a desired manner without interfering with the new reeling process that has started after the change and is effected by means of the second reeling cylinder. The reels are formed in the machine direction on the opposite sides of the reeling cylinder pairs in their own reeling stations, wherein they can also be moved in different locations of the plane of the machine hall.

The purpose of the invention is also to present a reel-up which provides new possibilities for the implementation of the change sequence of the reel, and new possibilities for the placement of accessory devices. To attain this purpose, the reel-up is primarily characterized in that the reeling stations are placed on the opposite sides of the pair. of web guiding devices, such as reeling cylinders. The reeling cylinders can be placed side by side so that their axes are substantially parallel to each other, wherein their centre axes are on the same height level or on different height levels, wherein their connecting plane can form an angle with the horizontal plane. The invention does not exclude the possibility that the reeling cylinders are placed on top of each other, wherein the aforementioned angle is 90 . In all cases, a passage is formed between the mantle surfaces of the reeling cylinders, via which the web is guided optionally onto either cylinder and the corresponding reel.

As for the other preferred embodiments of the invention, reference is made to the appended dependent claims and to the description hereinbelow.

BRIEF DESCRIPTION OF THE DRAWINGS

In the following, the invention will be described in more detail with reference to the appended drawings, in which.

DETAILED DESCRIPTION OF THE PREFERRED EMBODIMENTS

Figure 1:
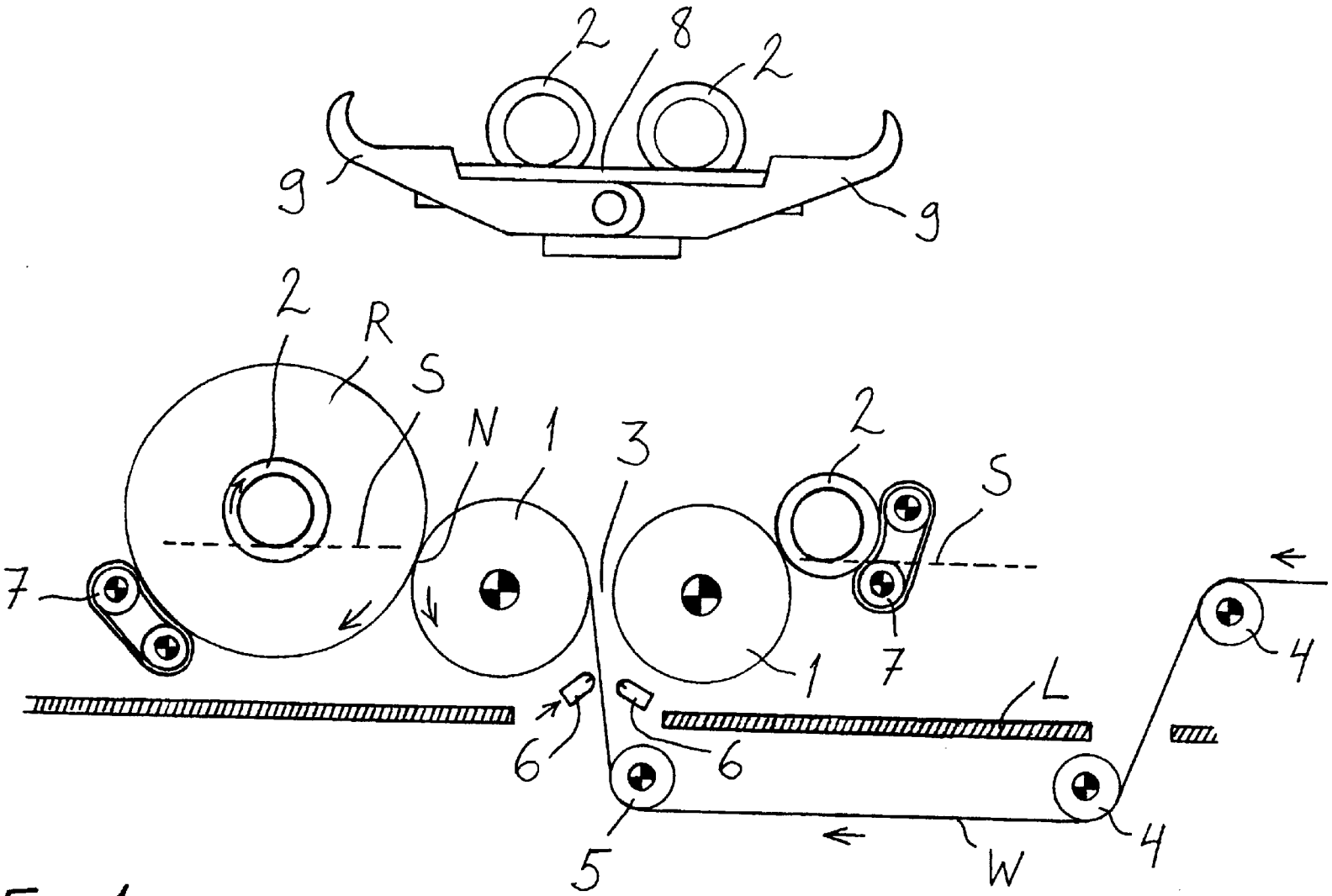
FIG. 1 is a side-view of a reel-up.

FIG. 1 shows a reel-up which is arranged to reel a continuous web W passed at a fixed web speed in the terminal end of the paper or paperboard machine or finishing apparatus for paper or paperboard, such as a coater. The reel-up comprises a reeling cylinder 1 arranged rotatable by means of a drive, over which reeling cylinder 1 the web W travels to a reel R within a given sector and through a reeling nip N between the reeling cylinder 1 and the reel R, to end around a reeling axle i.e. a reel axle rotating in a support structure. The reeling nip has a determined linear pressure as a result of the fact that the reeling cylinder 1 and the reel R are loaded against each other with a given force. This can be attained in a known manner by loading the reeling axle 2 towards the reeling cylinder 1 by means of a loading mechanism coupled to the ends of the reeling axle 2 or also by loading the reeling cylinder 1 against the reel R.

The paper or paperboard web W to be reeled is a full-width web which is typically several meters wide. This web is reeled around the same reeling axle to form a machine reel of several tonnes (e.g. over 5 tonnes) in weight, which reel can be rereeled later. Finally, the web is slitted into narrower part webs, which are wound to form customer rolls. The full-width web to be reeled has gone through a manufacturing or aftertreatment process in the sections preceding the reel-up, and the web is reeled substantially in the manufacturing or treatment width around the reeling axle, possibly in such a manner that trims have been cut off. Without restricting the concept of a full-width web to some fixed dimensions, it can be stated that the width of such a web to be reeled is typically over 3 m, and in wider machines it is in the order of about 8–10 m.

The support structures of the reeling axle 2 can be reeling rails along which the ends of the reeling axle move during the reeling, or a reeling carriage which receives the entire weight of the reel and is movable with suitable motion means in accordance with the growth of the reel R, e.g. along a path of motion in the direction of the horizontal plane. In FIG. 1, these structures are marked schematically with a broken line S. The support structures constitute a reeling station in which most of the reel is formed and in which it becomes full before the reel change.

The reel-up also comprises a second reeling cylinder 1, which is arranged in parallel with the first reeling cylinder so that their centre axes are approximately within a fixed distance from each other and aligned with respect to the cross machine direction. The cylinders rotate in opposite directions. The mantle surfaces of the reeling cylinders are located opposite to each other and in between them they form a narrowing and then again widening space 3, wherein the narrowest point is located in the area where the mantle surfaces are closest to each other.

The reeling cylinders 1 form a pair, on both sides of which there is a reeling station for producing the reel R by means of a corresponding reeling cylinder. The reels R are thus formed over the same area in the cross direction of the machine or apparatus. In FIG. 1, the reeling station of the first reeling cylinder 1 is located substantially after the reeling cylinder in the longitudinal direction of the machine, approximately in accordance with the geometry used in known Pope reel-ups. The second reeling cylinder 1 is located before the first reeling cylinder 1 in the longitudinal direction of the machine, and its reeling station, in turn, is located before this second reeling cylinder 1. The web W is passed towards the reeling cylinders 1 underneath the second reeling station in the longitudinal direction of the machine, i.e. it has such a travel path that it has sufficient space to travel beneath the full reel located in the second reeling station. The web W is guided to the reeling cylinders 1 via the space 3 between the reeling cylinders 1, in which it travels either to the first or to the second reeling cylinder 1.

In the situation shown in FIG. 1, the paper or paperboard web W is passed to the reel-up from underneath via a spreader roll 5. The web W is guided downwards by means of a first guide roll 4 located before the reel-up in the machine direction, over which guide roll 4 the web W wraps and will be guided onto the lower level in which it is guided forward to the spreader roll 5 by means of a second guide roll 4. The lower level on which the second guide roll 4 is located can be situated below the floor level L of the machine hall to maintain the height of the reel-up on a normal level. The spreader roll 5 by means of which the web W turns upwards, is located approximately by the space 3 between the reeling cylinders 1. The web W is passed from the spreader roll 5 obliquely upwards, via an opening located underneath the space 3, to the first reeling cylinder 1. On the first reeling cylinder 1 the web W wraps it over a certain sector running through the apex of the cylinder and is guided onto the reel R via a reeling nip N located on the opposite side of the cylinder. In FIG. 1, the reeling nip N is located above the horizontal plane extending via the centre axis of the reeling cylinder 1 at an angular distance of 0°–90° from the horizontal plane, but it can also be located underneath the horizontal level if the reeling cylinder 1 is in a sufficiently high position.

The free section of the web W between the spreader roll 5 and the reeling cylinders 1 is provided with change devices 6 on both sides of the web W. The change devices are placed before the narrowest point of the space 3 between the reeling cylinders 1 in the travel direction of the web. The purpose of the change devices is to change the run of the web from the first reeling cylinder to the second one and vice versa at a particular moment of time in the change sequence.

In the situation shown in FIG. 1, the reel R reeled via the first reeling cylinder 1 is becoming full. The second reeling cylinder 1 is in a standstill or it is rotating at a speed lower than the web speed, and the empty reeling axle 2 has been brought from the reel spool storage to the vicinity of the second reeling cylinder 1, whereafter it has been brought in contact with the cylinder by means of a device for initial reeling. The web W is cut by means of the change device 6 located on the same side of the web W with the first reeling cylinder 1, which change device can be a cutting device effecting a full-width cross cutting by means of a cutting stroke, or a cutting device moving across the web W. The cutting device can be brought in contact with the web before the cross cutting in the direction illustrated by the arrow. At the latest at the moment of cutting, the empty reeling axle 2 is in contact with the second reeling cylinder 1, and the reeling cylinder 1 and the reeling axle 2 therewith are accelerated to the web speed. The new end of the web W after the cutting point is guided to the second reeling cylinder 1 and over the same to the nip between the empty reeling axle 2 and the cylinder e.g. by utilizing air blast devices brought to the space 3. To guide the web W around the empty reeling axle 2 after the nip, it is also possible to use air blasts.

Figure 2:
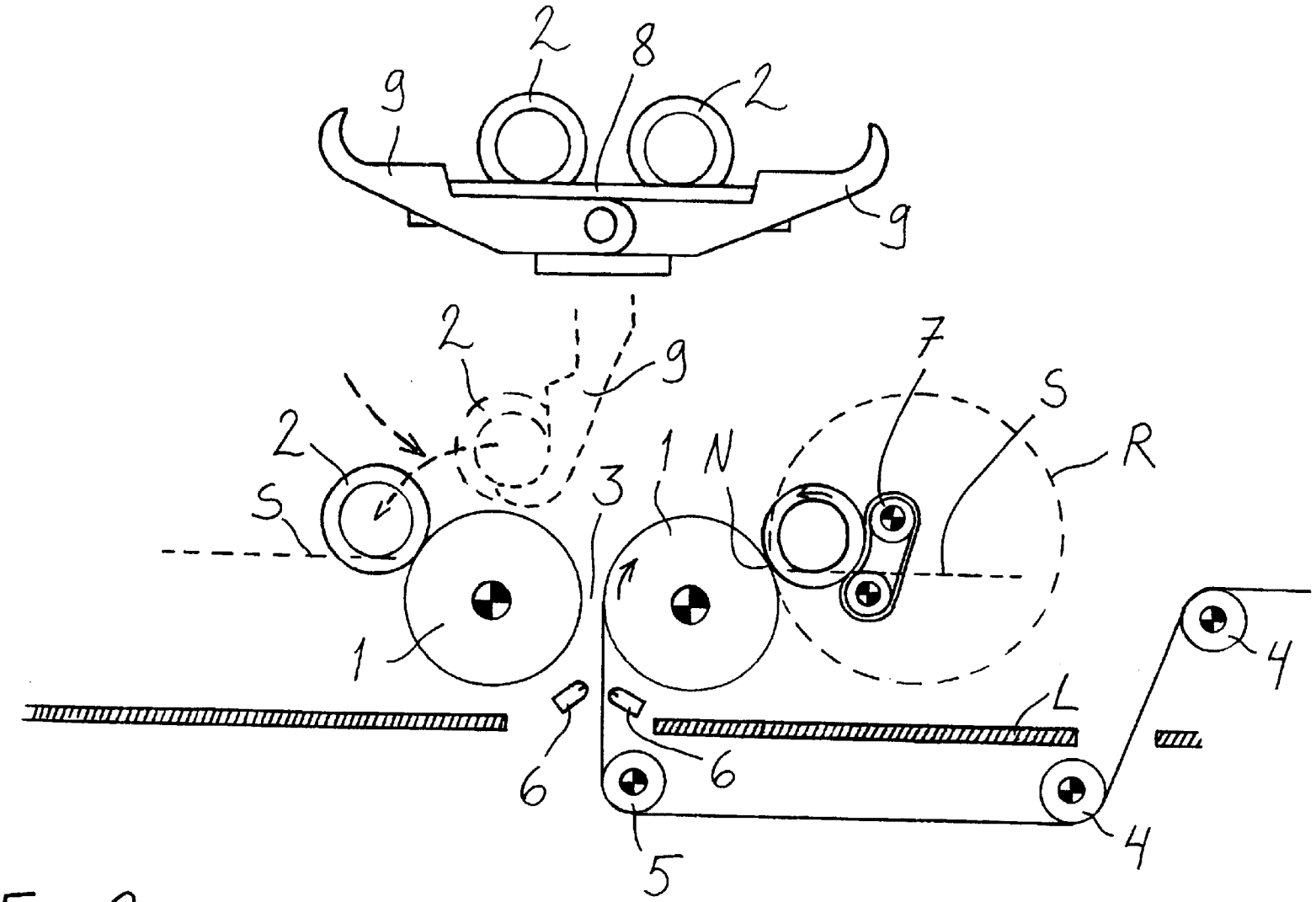
FIG. 2 shows the reel-up of FIG. 1 in a change situation.

FIG. 2 illustrates the situation after the change. The web W travels onto the second reeling cylinder 1 via the space 3 between the cylinders, and turns against the original incoming direction of the web W guided by the reeling cylinder 1. The reeling nip N is located after the apex of the second reeling cylinder 1 in the direction of rotation of the cylinder, in the same area as on the first reeling cylinder 1. The full-sized reel R existing in the second reeling station at the final stage of the reeling is illustrated with a broken line.

Since the change of the reel and the reeling process following thereafter takes place in its entirety by means of the second reeling cylinder 1, it is possible during the change and thereafter to handle the reel which is becoming full or is finished without having to pay attention to the ongoing change sequence or to the reeling process onto a new reel. Before the change at the final stage of the reeling process, the reel R is constantly in contact with the first reeling cylinder 1 through the nip N, and it is not necessary to move the reel R further apart, and correspondingly, separate press devices are not necessary to prevent the access of air to the reel. After the change the full reel R is advantageously stopped without opening the reeling nip N between the first reeling cylinder 1 and the reel R, i.e. the reel R is braked when the nip is closed. Because the first reeling cylinder is free from the web, its speed can be decelerated in a desired manner, and the reel is most advantageously stopped by braking the reeling cylinder 1, which transmits the braking force to the reel R by surface drive. When the reel is stopped or its speed has decreased under a suitable value, the reel R is detached from the contact with the reeling cylinder 1 and transferred away from the reel-up. When the reel has been detached from the reeling cylinder, a new empty reeling axle 2 can be brought immediately from the reel spool storage into connection with the reeling cylinder 1 to wait for a new change which now takes place from the second reeling cylinder 1 to the first analogously with the above-described change sequence. Thus, the change device 6 on the same side of the web W with the second reeling cylinder 1 conducts the cutting off and the web W is guided to the first reeling cylinder 1 again, on whose periphery it turns towards the empty reeling axle 2.

The reeling process can be implemented by means of a surface drive from the reeling cylinder 1, wherein a centre-drive is not necessary in either reeling station. The invention is not, however, restricted to reel-ups functioning on the surface drive principle, but it is possible and often advantageous to provide one or both reeling stations with a centre-drive of the reeling axle 2. Thus, when the web is cut off and changed, the reel can be stopped by braking by the centre-drive, and the nip between the reeling cylinder and the reel is still closed advantageously at least for the duration of the initial stage of the braking, e.g. most of the braking time, or until the reel has stopped rotating. The invention can also be used in such a way that after the change the nip is opened and the reel is stopped separately from the reeling cylinder 1 by braking by the centre-drive.

FIGS. 1 and 2 also show auxiliary reeling devices 7, which are arranged in corresponding reeling stations in contact with the reel R after the nip N in the direction of rotation of the reel R. The auxiliary reeling devices are driven, and their surface, which is in contact with the reel, travels at the peripheral speed of the reel. They can be composed of a rotating roll, or, as shown in FIGS. 1 and 2, of a belt loop guided by several rolls, the belt of which belt loop is located against the surface of the reel within a particular section. The point in which the reel enters the contact with the corresponding auxiliary reeling device 7 is advantageously in the area of the lower half of the reel R.

Before the reel change, the auxiliary reeling device 7 can be set in contact already with the mantle of an empty reeling axle 2, wherein it simultaneously guides the web W around the reeling axle. When a belt device is used, the belt holds the web against the reeling axle 2 within a given section. The auxiliary reeling device 7 is arranged to move along with the growth of the reel, and this path of motion, which in FIG. 1 is marked with broken line arrows, can be implemented with a suitable mechanism. The auxiliary reeling device 7 does not have to cover the full width i.e. it does not have to correspond to the width of the reel, but it can be arranged in the central area of the reel in the transverse direction. Furthermore, it is possible to use numerous separate auxiliary reeling devices contemporaneously in the same reeling station.

When a full reel R is stopped with a surface drive by braking the reeling cylinder 1, the auxiliary reeling device 7 is detached, its speed can be reduced concurrently with the reeling cylinder, or it can rotate freely with the reel. If the full reel is stopped by braking by the centre-drive so that the nip between the reeling cylinder and the reel is open, the auxiliary reeling device can still be maintained in contact with the reel, and it can be used to prevent the unrolling of surface sheets.

Figure 3:
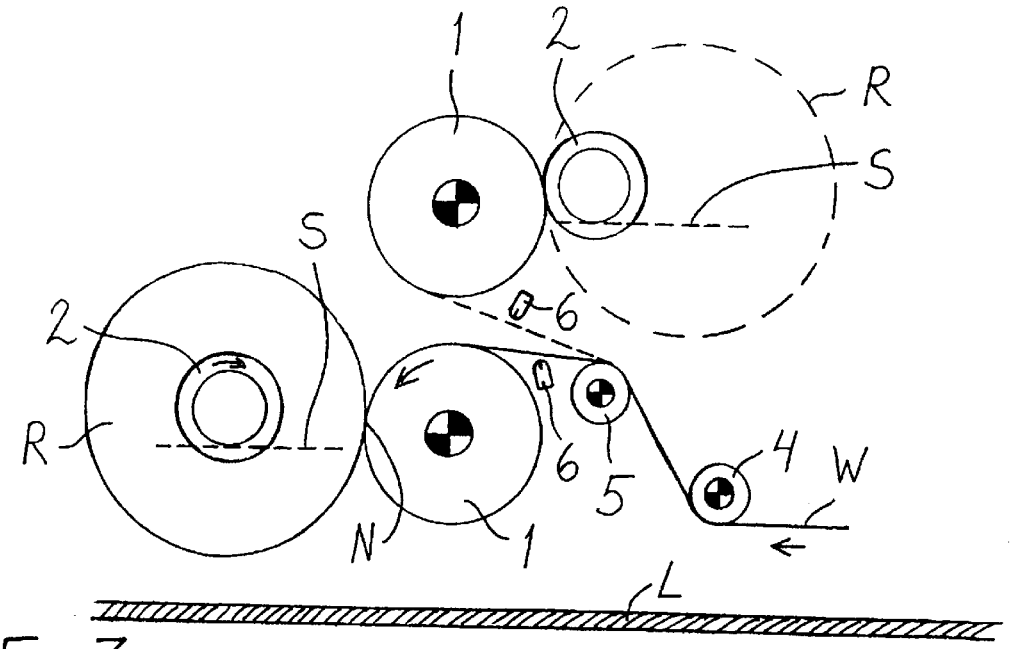
FIG. 3 shows a side-view of a second embodiment of the reel-up according to the invention.

FIGS. 1 and 2 show a construction in which the reeling cylinders 1 are placed one after the other in such a way that the connecting plane of their centre axes is approximately horizontal. The structures of the reeling cylinders 1 and reeling stations in the reel up are advantageously identical in such a way that the entire structure is as mirror-symmetrical as possible when the space 3 between the reeling cylinders 1 constitutes the centre line. FIG. 3 shows another possibility to provide the reel-up with two reeling cylinders 1. Here, the reeling cylinders 1 are located on top of each other, i.e. the connecting plane of their centre axes is located in an angle of 90° with respect to the horizontal plane. The spreader roll 5 guides the web W into the space 3 between the reeling cylinders 1 approximately along the longitudinal direction of the machine. Between the spreader roll 5 and the mantles of the reeling cylinders 1 there are change devices 6 whose function is similar to that described hereinabove. The run of the web W changed from the first reeling cylinder 1 to the second one is illustrated with broken lines, and the full-sized reel R reeled in the reeling station of the second reeling cylinder 1 is also illustrated with broken lines. The geometry of FIG. 3 reduces the machine length but correspondingly increases the height, and as a result, in the reeling station located first in the longitudinal direction of the machine (in the primary travel direction of the web), the reel R to be reeled has to be handled in a significantly higher position than the second reel.

The reeling cylinders 1 can be placed with respect to each other also in such a way that the position is an intermediate form of the geometries of FIGS. 1 to 2 and, on the other hand, of the geometry of FIG. 3. The cylinders 1 can be located in an inclined relationship, i.e. the connecting plane of their centre axes can form an angle of 0°–90° with the horizontal plane on the entrance side of the web W, i.e. on the side from which the web is guided between the cylinders 1. To prevent the second reeling station from being raised too high with respect to the first one, the reeling cylinders 1 are positioned advantageously at an angle of max. 45°, more advantageously at an angle of max. 30°. Most advantageously the aforementioned angle is in the range of 0° to 15°.

Figure 4:
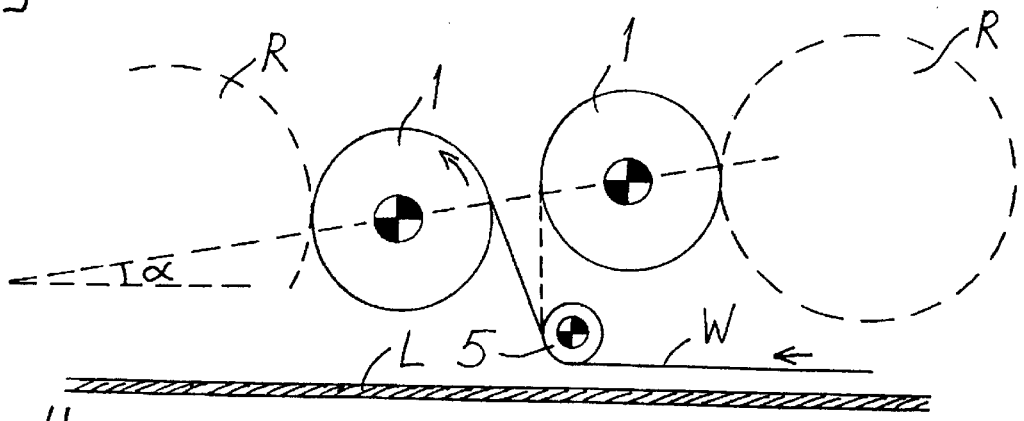
FIGS. 4–5 show a side-view of a third and a fourth embodiment.

FIG. 4 shows an alternative in which the reeling cylinders 1 are located at a different height, and the angle $\alpha$ is about 10°. The reeling cylinder 1 located first in the longitudinal direction of the machine is located in a higher position, and the web W can be brought to the pair of reeling cylinders 1 above the floor level L underneath the first located reeling cylinder 1 and the corresponding reeling station.

Figure 5:
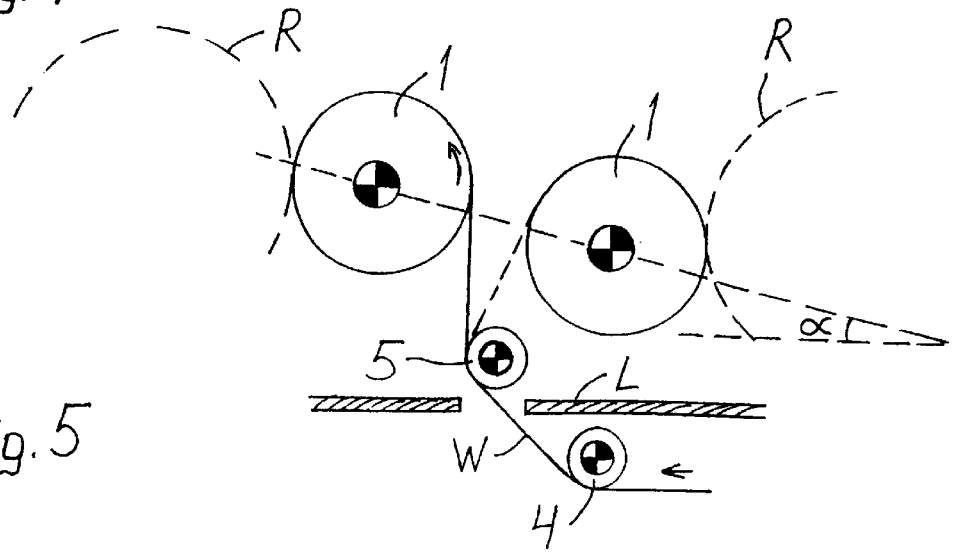

FIG. 5 shows a case in which the aforementioned angle is ca. 20° and the latter reeling cylinder 1 in the longitudinal direction of the machine is located at a higher position.

The solutions of FIGS. 3 to 5 entail the same possibilities to use the auxiliary reeling devices 7 as in FIGS. 1 to 2. The reeling axles 2 are provided with centre-drives, but it is possible to conduct the reeling process also with a surface drive only.

The reeling cylinders 1 are placed so close to each other that the change of the web onto the opposite mantle surface can be easily performed. Thus, the narrowest point in the space 3 between the reeling cylinders is sufficiently narrow, so that it is necessary to deviate the new end of the web only as little as possible from its original direction in order to pass it onto the opposite reeling cylinder. The minimum distance between the mantles, i.e. the width of the narrowest point in the space 3, should be at least smaller than the diameter of the reeling cylinders, and if the reeling cylinders have different sizes, it should be smaller than the diameter of the reeling cylinder. The minimum distance in the space 3 is advantageously smaller than the radius of the reeling cylinders, or the radius of the smaller reeling cylinder. The reeling cylinders that are located close to each other are an advantageous solution also in view of the machine length or height.

Figure 6:
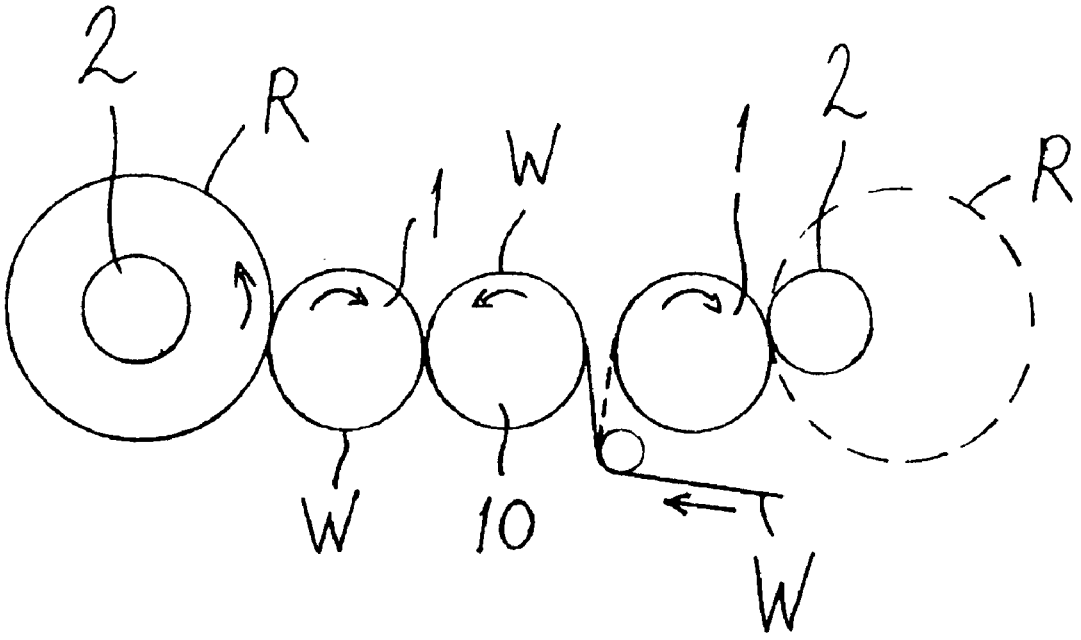
FIGS. 6–7 show embodiments by means of which the same side of the web is always facing outward in the reel.

In the solutions of FIGS. 1 to 5, the reeling cylinders 1 are rotating in opposite directions, wherein a space 3 is formed between their opposite mantle surfaces, via which space 3 the alternative runs of the web W are passed. When the web is changed from one cylinder to another, the other surface of the web is simultaneously positioned against the reeling cylinder. As a result of this, that side of the web which on the preceding reel was facing outwards, will face inwards on this new reel. This does not usually cause any inconveniences, but e.g. in the case of coated paperboards or other grades, it might be desired that the web is always positioned the same side out in the reel. In FIG. 6 this has been solved in such a way that the reeling cylinders 1 are arranged to rotate in the same direction, and there is a turning device, such as a reversing roll between them. Between the reversing roll 10 and one of the reeling cylinders 1 a space is formed, via which the alternative runs of the web travel, either to the reeling cylinder 1 and via its upper part to the reeling nip, or to the reversing roll 10 rotating in a direction opposite to the reeling cylinder 1, the reversing roll 10 delivering the web to the reeling cylinder 1, over whose lower sector the web W wraps and travels to the reeling nip. By means of the turning device it is possible to set the same surface out on the reeling cylinder 1 located after the turning device as on the reeling cylinder 1 to which the web is passed without the turning device.

Figure 7:
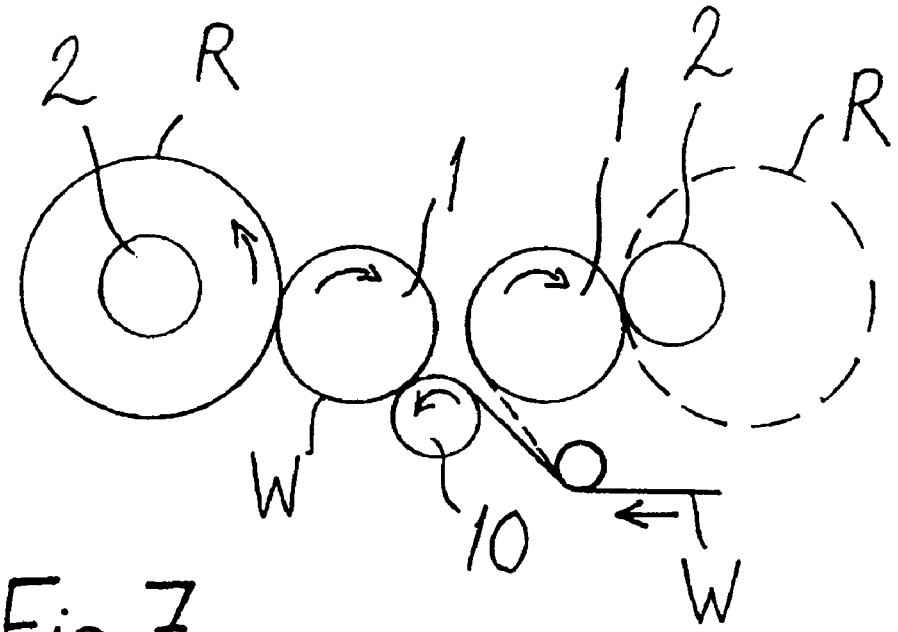

FIG. 7 shows an arrangement that produces a corresponding result, in which arrangement the turning device, such as a reversing roll, effecting a corresponding turning, is not located in the narrowest point between the reeling cylinders 1, but below the narrowest point between the reeling cylinders. In other respects the principle equals that of FIG. 6, i.e. the alternative runs of the web travel via the narrowest point between the reeling cylinder 1 and the reversing roll 10, either directly to the reeling cylinder or via the reversing roll 10 to the sector on the mantle of the other reeling cylinder 1 which succeeds the narrowest point between the reeling cylinders 1 in the direction of rotation.

In the solutions of FIGS. 6 and 7, it is possible to use change devices in the travel direction of the web before the second reeling cylinder 1 and the reversing roll 10 in a similar way as in FIGS. 1 to 2. Likewise, it is possible to use auxiliary reeling devices 7 according to the same principle as in FIGS. 1 to 2. The reeling axles may be provided with a centre-drive or the reeling can be effected with a surface drive.

Figure 8A:
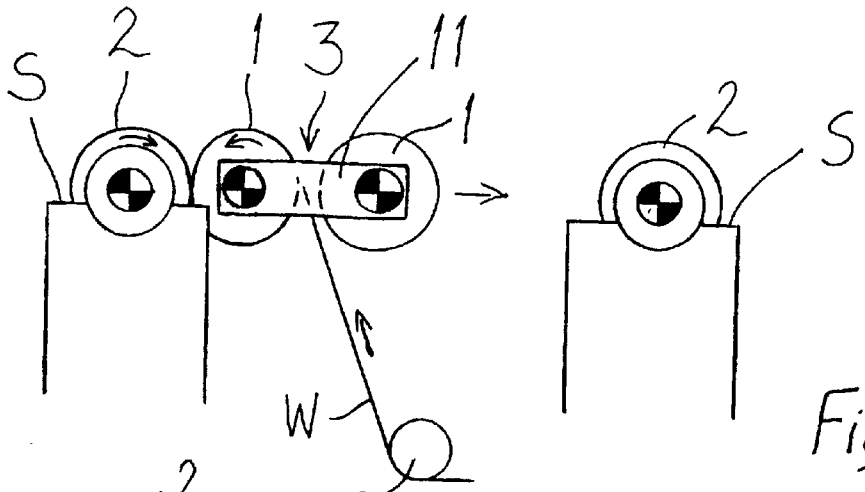
FIGS. 8*a–c* show an embodiment equipped with moving reeling cylinders.
Figure 8B:
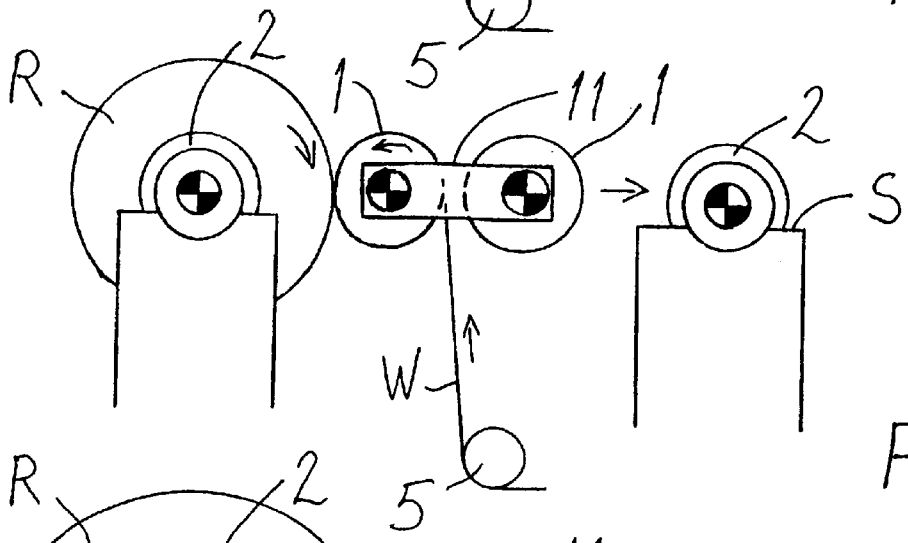
Figure 8C:
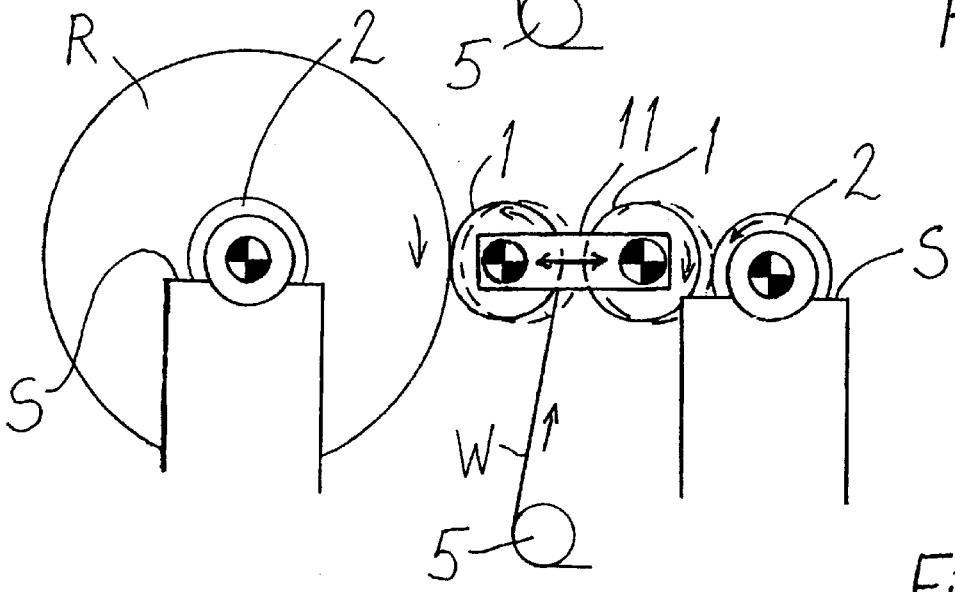

FIGS. 8*a* to 8*c* present a solution which enables the loading between the reeling cylinder 1 and the reel R by means of a loading mechanism connected to the reeling cylinder 1. In FIG. 8*a,* the reeling axle 2 is stationary in the reeling station during the reeling process to collect the web W passed via the first reeling cylinder 1 onto the reel R. To compensate for the growth of the reel, the reeling cylinder 1 is provided with the possibility of moving away from the reeling axle 2 approximately in horizontal direction (FIGS. 8*a* and *b*). When the reeling cylinder 1 is moving, it is simultaneously loaded against the reel R to produce acertain linear pressure in the reeling nip N. The arrangement is in other respects similar to that of FIGS. 1 to 2, i.e. the web W is passed between the pair of reeling cylinders 1 onto the first reeling cylinder 1 and the alternative runs of the web travel via the narrowest point in the space 3 between the reeling cylinders. When the reel R has become full, the change sequence can be performed in the way described in connection with FIGS. 1 to 2. The web W is transferred onto the opposite mantle of the second reeling cylinder 1 in the situation of FIG. 8*c,* in which the second reeling cylinder 1 and the empty reeling axle 2 are brought in contact with each other (illustrated with a broken line). This second reeling cylinder 1 can also move along with the growth of the reel R and it can be loaded against the reel when the reeling axle 2 in the corresponding reeling station remains stationary. This reeling cylinder 1 moves to the direction opposite to the direction of motion of the first reeling cylinder 1 during its reeling process (illustrated with a broken line arrow).

The cylinders 1 can be independently movable back and forth between the reeling stations, wherein the first reeling cylinder 1 moves towards the second one and vice versa. FIGS. 8*a* to 8*c,* however, show a structure in which the pair of reeling cylinders 1 is arranged to move in the same support structure 11 back and forth in the direction of the reeling stations. The support structure 11 can be arranged movable e.g. on the support and under the guiding action of suitable guides. An advantage of the solution according to FIGS. 8*a* to 8*c* is that both reeling cylinders 1 may share the same loading and transfer devices, i.e. they can be connected to a common loading and transfer mechanism. The distance between the reeling cylinders 1 remains constant during the transfer. The reel R can be grown in the first reeling station until the second, free reeling cylinder 1 enters the contact with the empty reeling axle 2, whereafter the change is conducted. The full reel has to be taken away so that the new reel can start to grow. The distance between the reeling stations and the size of the reels to be produced can be dimensioned with respect to each other so that in the situation of FIG. 8*c,* the nipping contact between the first reeling cylinder 1 and the reel R that is becoming full can be released, and the structure 11 can be transferred somewhat further towards the new, empty reeling axle 2 until the second reeling cylinder 1 enters in contact therewith, after which the change can be conducted. Thus, there is room for the reeling cylinder 1 to move back towards the full reel R.

Furthermore, the distance between the reeling cylinders 1 can be arranged adjustable in the support structure 11 (illustrated with a double-headed arrow in FIG. 8*c*), so that in the change situation in particular, it would be possible to move the reeling cylinders in suitable positions in the structure 11. For example in the situation of FIG. 8*c,* the distance between the reeling cylinders 1 can still be adjusted so that it is optimal before the change, for example it can be reduced. For example, when the reeling cylinder 1 is in contact with the empty reeling axle 2, the second reeling cylinder 1 can be moved apart from the full reel towards this reeling cylinder, or if it has initially been off the reel, it can be moved further away from the reel and closer to the reeling cylinder. The change devices can also be placed so that they move along with the common support structure 11.

The support structures S of the reeling axles 2 have a stationary position. Instead of stationary frame structures, it is also possible to use carriages held in place as support structures S, by means of which carriages the full reel can be moved away in the direction of the reeling axle 2.

Figure 9A:
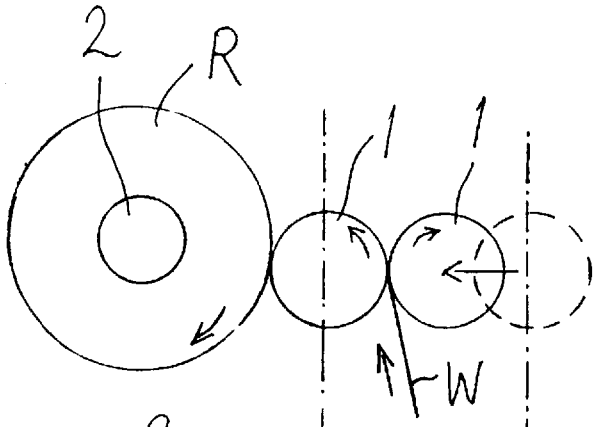
FIGS. 9*a–d* and 10*a* show an embodiment equipped with reeling cylinders moving alternately.
Figure 9B:
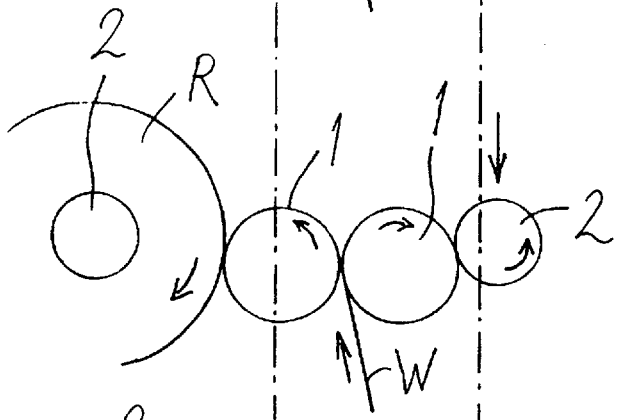
Figure 9C:
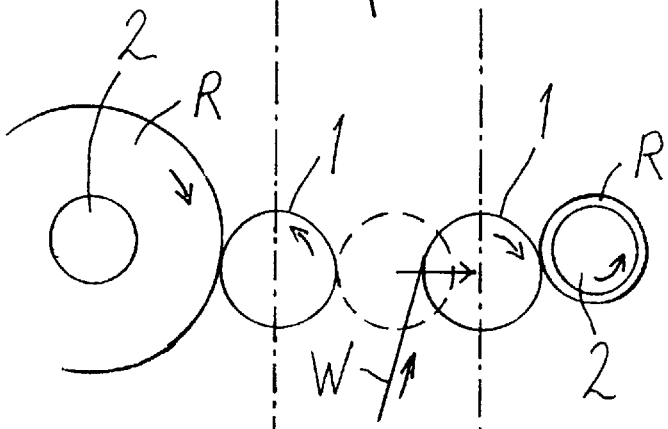
Figure 9D:
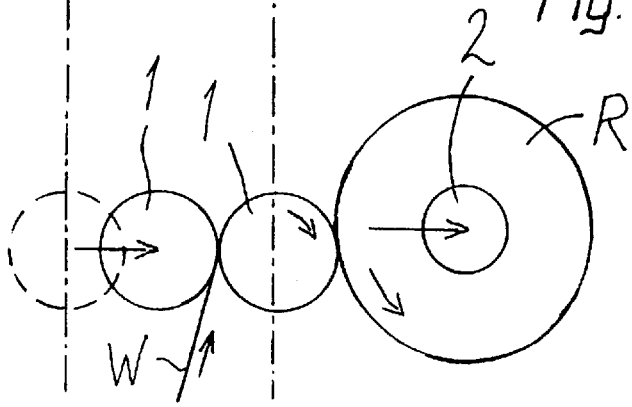

FIGS. 9*a–c* illustrate schematically one way of changing the web W from one reeling cylinder to another. Here, the condition is that the reeling cylinders 1 are capable of moving with respect to each other between the reeling stations. The reeling can be effected on the principle shown in FIGS. 1 to 2, i.e. the reeling cylinders 1 are stationary and the reeling axle 2 moves away from the reeling cylinder on the support of the support structure S. When the reel is becoming full, the second reeling cylinder 1 is brought from its fixed position closer to the first reeling cylinder 1 in order to conduct the change, i.e. the space 3 between the reeling cylinders is reduced. The reeling cylinder 1 can be brought very close to the web W travelling on the reeling cylinder 1, e.g. in contact with the same. Before the change, at the latest, the new reeling axle 2 is brought in contact with the second reeling cylinder 1 and the change is conducted (FIG. 9*b*), wherein the web wraps over the second reeling cylinder 1, and e.g. guided by suitable auxiliary devices it is wound around a new reeling axle 2. Thereafter the second reeling cylinder 1 together with the reeling axle 2 and the reel formed around the same can be moved further away from the first reeling cylinder 1, and stopped in the fixed position of its own (FIG. 9*c*). Thereafter the reeling process can be accomplished and when the reel R becomes full in this reeling station, the first reeling cylinder 1, in turn, moves from its fixed position closer to the second reeling cylinder 1, possibly in contact with the web passed via the second reeling cylinder 1 onto the reel R, and the change can be conducted analogously with the principle of FIGS. 9*a–b*.

In FIGS. 9*a–d* the reeling is accomplished when the reeling cylinder 1 rotates in its fixed position and the reeling axle 2 moves further away from the reeling cylinder in the support structure. After the web W has been cut off, the reeling cylinder 1 can remain in nip contact with the full reel R for the duration of the braking of the reel R in a similar way as described above.

Figure 10A:
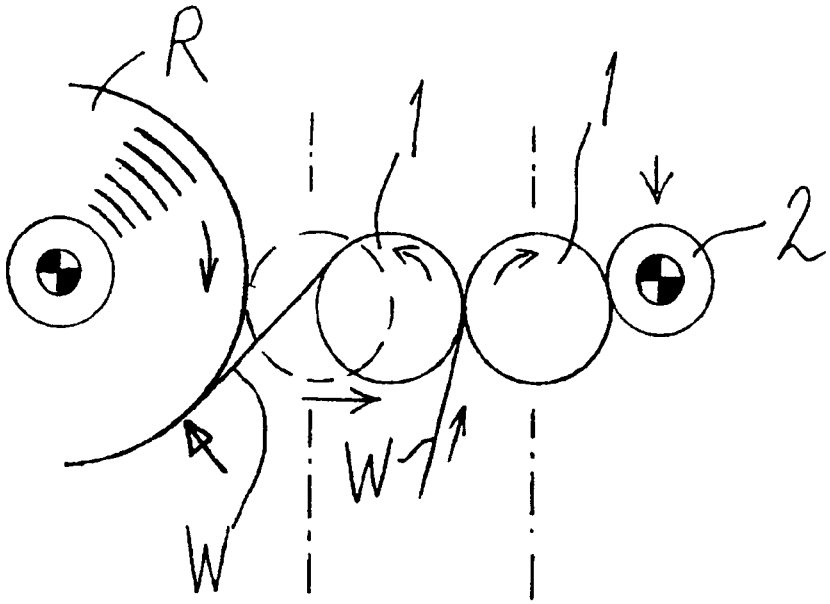
Figure 10B:
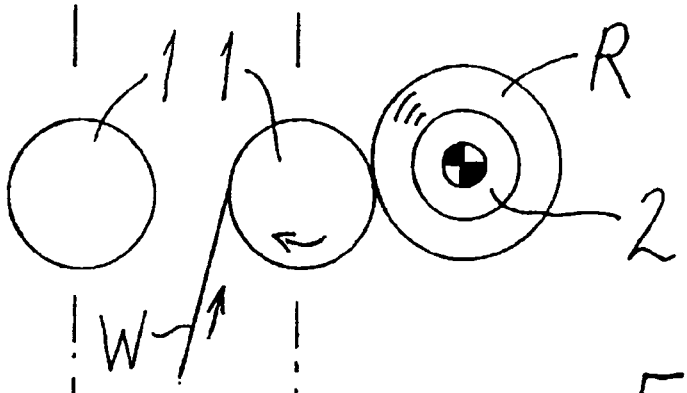
Figure 10C:
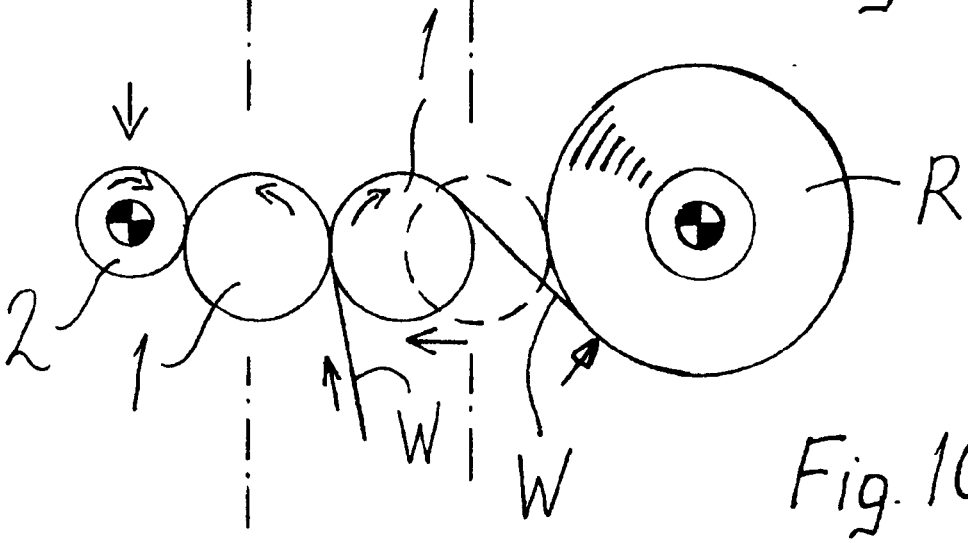

FIGS. 10*a–c* show an embodiment in which the distance between the reeling cylinders 1 can also be reduced to conduct the change. The reeling process takes place along the same lines as in FIGS. 9*a–d,* i.e. the reeling cylinder 1 rotates in its position during the reeling process and the reeling axle 2 moves further away. When the reel R is becoming full, the nip is opened by moving the reeling cylinder 1 executing the reeling process closer to the second reeling cylinder 1 (FIG. 10*a*). Also in this case the reeling cylinders 1 can be brought in nip contact with each other. Since the nip N between the first reeling cylinder 1 and the reel R is open, it is possible to utilize the decreasing peripheral speed of the reel to produce a slackening web, which e.g. with a change similar to a bag change can be transferred to the second reeling cylinder 1. Thus, thanks to the possibility of motion of the reeling cylinder, it is not necessary to transfer the reel R to open the nip. After the web has been broken off the new web travels via the mantle of the second reeling cylinder 1 to the new reeling axle 2 brought into connection with the reeling cylinder, and the web begins to accumulate around it to form a reel. After the change the first reeling cylinder 1 can be moved back to its fixed position (FIG. 10*b*). FIG. 10*c* again shows the change from the second reeling cylinder to the first one, which takes place analogously with the process shown in FIG. 10*a*.

In the embodiments of FIGS. 10*a–c* it is also advantageous to use a special press device, such as a brush device or a press roll, which is brought in contact with the reel R to prevent access of air under the topmost layers when the nip is open. In the drawings, this press device is described schematically with an arrow.

In the embodiments of FIGS. 8 to 10, the reeling axle 2 is equipped with a centre-drive, but the reeling process can also be effected only by means of surface drive with the reeling cylinder 1.

To secure the change, it is possible to utilize a suction in the reeling cylinders 1 which is directed through the mantle via openings and which suction can be restricted, if desired, e.g. to a given rotation sector, i.e. for example to the area between the entrance point of the web and the reeling axle 2. The suction arrangements can be e.g. similar to those known from the Finnish patents 74446 and 98506.

Figure 11:
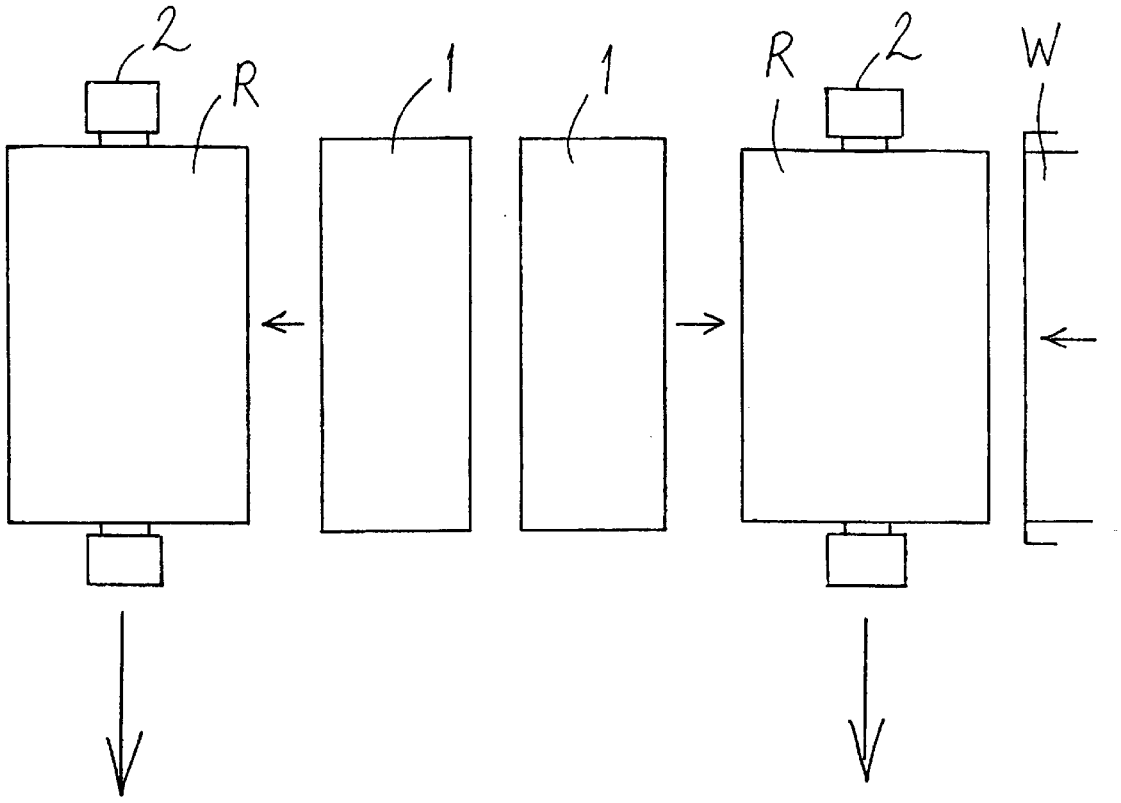
FIG. 11 is a schematical top view of the reeling process and the act of transferring complete reels.

FIG. 11 shows how reeling axles and the reels formed around them can be removed from reel-ups made according to the above-described embodiments. Since the reel-up composed of two reeling cylinders and reeling stations increases the machine length, it is advantageous to remove the reels R from the reel-up in the direction of the reeling axles 2, i.e. in the cross direction of the machine, so that rolling rails or corresponding structures for removing the reels in the machine direction would not increase the length. After the reeling process the reel is transferred in the machine direction only a distance which is necessary for detaching it from the reeling cylinder, at the most to a distance from the reel equalling the radius of the complete reel and preferably at the most to a distance equalling half of the radius of the reel R. If the reeling cylinder 1 is movable, it is also sufficient that the reeling cylinder 1 is taken off the reel to the aforementioned distances and the reel R can remain stationary, and it can be taken directly from this position in the direction of the reeling axle. To perform the transfer, the reel R is supported during the reeling process in the reeling station by the reeling carriage, which after the reeling is transferred away from the reel-up in the transverse direction, or a reel reeled while having been supported by a fixed support structure, such as rails, is lifted up by means of a crane and moved away from the reel-up in the lateral direction. The aforementioned ways for removal can be carried out only in one of the reeling stations or advantageously in both of them, as shown in FIG. 11.

FIGS. 1 to 2 show a reel spool storage 8 shared by both reeling cylinders and reeling stations, from which storage empty reeling axles 2 can be lowered alternately into connection with the reeling cylinders 1. The reel spool storage is located above the pair of reeling cylinders and from the ends of its horizontal support structure supporting several reeling axles 2 in succession in the machine direction, it is possible to lower a new reeling axle 2 with transfer devices 9, such as lowering arms into connection with the corresponding reeling cylinder 1, to the devices for initial reeling of the reeling station, which can be known as such. In FIG. 2, this transfer stage is illustrated with arrows and broken lines. Similarly, it is possible to use known auxiliary devices and control devices in connection with the reeling stations without deviating from the inventive idea.

Even though it was mentioned above that the reeling is effected alternately via the reeling axles, the change of the reel can be conducted via the same reeling axle with a normal change. Thus, it is possible to use the same reeling axle to reel several reels successively, and the other reeling axle and the corresponding reeling station are out of use for a longer period of time, wherein they can be serviced. It is possible to conduct short service for the free reeling cylinder and reeling station also when one reel is reeled with the other reeling cylinder and the web is changed thereafter to the free reeling cylinder.

The reeling cylinder 1 journalled rotatable is described above as a device guiding the web W to the reel. It is, however, possible to use any surface moving in the travel direction of the web that receives the web entering the reel-up and guides the web onto the reel. According to the basic idea of the invention, there are two such devices guiding the web and comprising a corresponding moving surface, and they guide the web alternately to different reeling stations during continuously operating reeling-up.

In the following, the patent claims will be given, and the various details of the invention can show variation within the scope of the inventive idea defined in the claims and differ even to a considerable extent from the details stated above by way of example only. As such, the examples provided above are not meant to be exclusive and many other variations of the present invention would be obvious to those skilled in the art, and are contemplated to be within the scope of the appended claims.

What is claimed is:

1. A method for reeling a web in a paper or paperboard machine, comprising the steps of:

arranging a first and second web guiding device as a pair in said paper or paperboard machine;

arranging a first reeling station outwardly with respect to said first guiding device and arranging a second reeling station outwardly with respect to said second guiding device, wherein the first and second reeling stations are located on opposite sides of the pair of web guiding devices;

guiding a web onto a first reeling axle located in one of said first and second reeling stations via a corresponding one of said first and second guiding devices through a reeling nip between the web guiding device and the first reeling axle;

forming a first reel on said first reeling axle;

guiding said web onto a second reeling axle located in an other one of said first and second reeling stations via a corresponding other one of said first and second guiding devices through a reeling nip between the web guiding device and the second reeling axle;

providing said first and second web guiding devices with surfaces moving in a same direction as one another;

arranging a reversing roll between said first and second guiding devices, and wherein a first surface of said web is guided along said one of said first and second guiding devices surfaces so that said first surface of said web faces outward when said web is reeled on either one of said first and second reeling axle and said same first surface faces outward when said web is reeled onto an other one of said first and second reeling axle; and wherein said first and second guiding devices comprise suction reeling cylinders.

2. The method according to claim 1, further comprising the step of:

reducing a rotational speed of said first reeling axle when said first reel has become full and after said web has been guided onto said second reeling axle.

3. The method according to claim 2, further comprising the step of:

stopping said first reel after said web has been guided onto said second reeling axle.

4. The method according to claim 2, wherein all of the steps of said process are conducted while a nip defined between one of said first and second reeling axles and a corresponding one of said first and second guiding devices is in a closed position.

5. The method according to claim 1, further comprising the step of:

transferring said first and second reeling axles to said first and second reeling stations from a common storage location.

6. The method according to claim 1, further comprising the step of:

effecting said reeling by means of at least one of said first and second web guiding devices via surface drive means.

7. A method for reeling a web in a paper or paperboard machine, comprising the steps of:

arranging a first and second web guiding device as a pair in said paper or paperboard machine;

arranging a first reeling station outwardly with respect to said first guiding device and arranging a second reeling station outwardly with respect to said second guiding device, wherein the first and second reeling stations are located on opposite sides of the pair of web guiding devices;

guiding a web onto a first reeling axle located in one of said first and second reeling stations via a corresponding one of said first and second guiding devices through a reeling nip between the web guiding device and the first reeling axle;

forming a first reel on said first reeling axle;

guiding said web onto a second reeling axle located in an other one of said first and second reeling stations via a corresponding other one of said first and second guiding devices through a reeling nip between the web guiding device and the second reeling axle; and providing said first and second web guiding devices with surfaces moving in a same direction as one another; and wherein a first surface of said web is guided along said one of said first and second guiding devices so that it faces outward when said web is reeled on either one of said first and second reeling axle and said same first surface faces outward when said web is reeled onto an other one of said first and second reeling axle.

8. A method for reeling a web in a paper or paperboard machine, comprising the steps of arranging a first and second web guiding device as a pair in said paper or paperboard machine;

arranging a first reeling station outwardly with respect to said first guiding device and arranging a second reeling station outwardly with respect to said second guiding device, wherein the first and second reeling stations are located on opposite sides of the pair of web guiding devices;

guiding a web onto a first reeling axle located in one of said first and second reeling stations via a corresponding one of said first and second guiding devices through a reeling nip between the web guiding device and the first reeling axle;

forming a first reel on said first reeling axle;

guiding said web onto a second reeling axle located in an other one of said first and second reeling stations via a corresponding other one of said first and second guiding devices through a reeling nip between the web guiding device and the second reeling axle; and passing said web in a longitudinal direction of the machine underneath one of said first and second reeling stations; and passing said web between said first and second web guiding devices.

9. The method according to claim 8, further comprising the steps of:

arranging said first and second web guiding devices one after the other in a machine direction; and passing said web upwards through said first and second web guiding devices in one of a vertical and inclined plane.

10. A method for reeling a web in a paper or paperboard machine, comprising the steps of:

arranging a first and second web guiding device as a pair in said paper or paperboard machine;

arranging a first reeling station outwardly with respect to said first guiding device and arranging a second reeling station outwardly with respect to said second guiding device, wherein the first and second reeling stations are located on opposite sides of the pair of web guiding devices;

guiding a web onto a first reeling axle located in one of said first and second reeling stations via a corresponding one of said first and second guiding devices through a reeling nip between the web guiding device and the first reeling axle;

forming a first reel on said first reeling axle;

guiding said web onto a second reeling axle located in an other one of said first and second reeling stations via a corresponding other one of said first and second guiding devices through a reeling nip between the web guiding device and the second reeling axle;

changing a run of said web from said first reel reeling axle to said second reeling axle when said first reel is full; and wherein said changing of said web run further comprises the step of cross cutting said web before said web enters said first and second web guiding devices.

11. The method according to claim 10, wherein said reeling of said web onto said first reel comprises providing said moving surface of said second web guiding device with a rotational speed that is less than a running speed of said web; and further comprising prior to guiding said web onto said second reeling axle, accelerating said moving surface of said second web guiding device substantially to said speed of said web.

12. A method for reeling a web in a paper or paperboard machine, comprising the steps of:

arranging a first and second web guiding device as a pair in said paper or paperboard machine;

arranging a first reeling station outwardly with respect to said first guiding device and arranging a second reeling station outwardly with respect to said second guiding device, wherein the first and second reeling stations are located on opposite sides of the pair of web guiding devices;

guiding a web onto a first reeling axle located in one of said first and second reeling stations via a corresponding one of said first and second guiding devices through a reeling nip between the web guiding device and the first reeling axle;

forming a first reel on said first reeling axle;

guiding said web onto a second reeling axle located in an other one of said first and second reeling stations via a corresponding other one of said first and second guiding devices through a reeling nip between the web guiding device and the second reeling axle;

changing a run of said web from said first reel reeling axle to said second reeling axle when said first reel is full;

reducing a distance between said first and second web guiding devices prior to changing said web from said first reeling axle to said second reeling axle; and bringing said first and second web guiding devices into contact with one another.

13. The method according to claim 12, further comprising the step of:

moving said second web guiding device closer to said first web guiding device before said web is changed from said first reeling axle to said second reeling axle.

14. The method according to claim 12, further comprising the step of:

moving said first web guiding device closer to said second web guiding device before said web is changed from said first reeling axle to said second reeling axle.

15. A method for reeling a web in a paper or paperboard machine, comprising the steps of:

arranging a first and second web guiding device as a pair in said paper or paperboard machine;

arranging a first reeling station outwardly with respect to said first guiding device and arranging a second reeling station outwardly with respect to said second guiding device, wherein the first and second reeling stations are located on opposite sides of the pair of web guiding devices;

guiding a web onto a first reeling axle located in one of said first and second reeling stations via a corresponding one of said first and second guiding devices through a reeling nip between the web guiding device and the first reeling axle;

forming a first reel on said first reeling axle;

by guiding said web onto a second reeling axle located in an other one of said first and second reeling stations via a corresponding other one of said first and second guiding devices through a reeling nip between the web guiding device and the second reeling axle;

providing said first and second web guiding devices with surfaces moving in a same direction as one another;

arranging a reversing roll between said first and second guiding devices, and wherein a first surface of said web is guided along said one of said first and second guiding devices so that it faces outward when said web is reeled on either one of said first and second reeling axle and said same first surface faces outward when said web is reeled onto an other one of said first and second reeling axle.

16. A reel-up for a paper or a paperboard web in a paper or paperboard machine, comprising:

at least a first and a second web guiding device defining a web travel path through which said web passes; and at least a first and second reel located in a corresponding first and second reeling station; wherein each of said first and second web guiding devices are structured and arranged to guide said web onto a corresponding one of said first and second reels located in said corresponding first and second reeling station through a corresponding reeling nip between each of said first and second web guiding devices and said corresponding one of said first and second reels; and wherein said first and second reeling stations are arranged on opposite sides of said first and second web guiding devices, wherein said first and second web guiding devices each include a corresponding moving surface;

means for guiding said web to the moving surface of said first web guiding device; and a turning device structured and arranged between said first and second web guiding devices for alternately passing said web to said first and second reels and wherein the moving surface of said first web guiding device is structured and arranged to rotate in a same direction to the moving surface of said second web guiding device; and wherein said means for guiding said web is structured and arranged to pass a first surface of said web to said first web guiding device such that said first surface contacts said first web guiding device and wherein said turning device is structured and arranged to pass said first surface to said second web guiding device such that said first surface contacts said second web guiding device as well.

17. The reel-up according to claim 16, further comprising:

a common storage means for a plurality of reeling axles to be shared by said first and second reeling stations.

18. The reel-up according to claim 16, wherein at least one of said first and second web guiding devices is structured and arranged to rotate said reeling axle and said reel in said corresponding reeling station by means of surface drive.

19. A reel-up for a paper or a paperboard web in a paper or paperboard machine, comprising:

at least a first and a second web guiding device defining a web travel path through which said web passes; and at least a first and second reel located in a corresponding first and second reeling station; wherein each of said first and second web guiding devices are structured and arranged to guide said web onto a corresponding one of said first and second reels located in said corresponding first and second reeling station through a corresponding reeling nip between each of said first and second web guiding devices and said corresponding one of said first and second reels; and wherein said first and second reeling stations are arranged on opposite sides of said first and second web guiding devices; and a corresponding moving surface on each of said first and second web guiding devices, wherein said first moving surface of said first web guiding device is structured and arranged to rotate in a same direction to said second moving surface of said second web guiding device, wherein said web passes between said first and second web guiding devices such that a first surface of said web is in contact with said first moving surface and said first surface of said web faces outward on said corresponding first reel, and said first surface of said web is in contact with said second moving surface and said first surface of said web faces outward on said corresponding second reel.

20. A reel-up for a paper or a paperboard web in a paper or paperboard machine, comprising:

at least a first and a second web guiding device defining a web travel path through which said web passes; and at least a first and second reel located in a corresponding first and second reeling station; wherein each of said first and second web guiding devices are structured and arranged to guide said web onto a corresponding one of said first and second reels located in said corresponding first and second reeling station through a corresponding reeling nip between each of said first and second web guiding devices and said corresponding one of said first and second reels; and wherein said first and second reeling stations are arranged on opposite sides of said first and second web guiding devices; wherein said travel path of said web is in a longitudinal machine running direction and beneath one of said reeling stations.

21. The reel-up according to claim 20, wherein said first and second web guiding devices are arranged one after another in a machine running direction and said travel path of said web is directed in one of a vertical and inclined direction upwards and between said first and second guiding devices.

22. The reel-up according to claim 21, wherein said first and second guiding devices are reeling cylinders having a central axis and wherein a plane of connection between said first central axis of said first reeling cylinder and said second central axis of said second reeling cylinder forms an angle of from 0 to about 45 degrees on an entrance side of said web.

23. The reel-up according to claim 22, wherein said angle is from 0 to about 30 degrees on an entrance side of said web.

24. The reel-up according to claim 22, wherein said angle is from 0 to about 15 degrees on an entrance side of said web.

25. A reel-up for a paper or a paperboard web in a paper or paperboard machine, comprising:

at least a first and a second web guiding device defining a web travel path through which said web passes; and at least a first and second reel located in a corresponding first and second reeling station; wherein each of said first and second web guiding devices are structured and arranged to guide said web onto a corresponding one of said first and second reels located in said corresponding first and second reeling station through a corresponding reeling nip between each of said first and second web guiding devices and said corresponding one of said first and second reels; and wherein said first and second reeling stations are arranged on opposite sides of said first and second web guiding devices;

wherein at least one of said first and second web guiding devices is movable;

a variable arrangement for the relative position of said first web guiding device with respect to said second web guiding device; and wherein said second web guiding device is structured and arranged to move toward said first web guiding device.

26. The reel-up according to claim 25, wherein at least one of said first and second web guiding devices is movably arranged in contact with one of a corresponding one of said reeling axles and one of said reels in said reeling stations.

27. The reel-up according to claim 25, wherein said first and second web guiding devices are structured and arranged in a common support structure to thereby move together.

28. The reel-up according to claim 26, wherein one of said reeling stations is structured and arranged for a stationary reeling axle.

29. The reel-up according to claim 25, further comprising:

a variable arrangement for the relative position of said first web guiding device with respect to said second web guiding device.

30. The reel-up according to claim 25, wherein said first web guiding device is structured and arranged to move toward said second web guiding device.

31. The reel-up according to claim 25, wherein said first and second web guiding devices are structured and arranged to be movable into nip contact with one another.

32. A reel-up for a paper or a paperboard web in a paper or paperboard machine, comprising:

at least a first and a second web guiding device defining a web travel path through which said web passes; and at least a first and second reel located in a corresponding first and second reeling station;

wherein each of said first and second web guiding devices are structured and arranged to guide said web onto a corresponding one of said first and second reels located in said corresponding first and second reeling station through a corresponding reeling nip between each of said first and second web guiding devices and said corresponding one of said first and second reels; and wherein said first and second reeling stations are arranged on opposite sides of said first and second web guiding devices;

wherein said first and second web guiding devices each include a corresponding moving surface;

means for guiding said web to the moving surface of said second web guiding device;

a turning device structured and arranged between said first and second web guiding devices for alternately passing said web to said first and second reels and wherein the moving surface of said first web guiding device is structured and arranged to rotate in a same direction to the moving surface of said second web guiding device; and wherein said means for guiding said web is structured and arranged to pass a first surface of said web to said first web guiding device such that said first surface contacts said first web guiding device and wherein said turning device is structured and arranged to pass said first surface to said second web guiding device such that said first surface contacts said second web guiding device as well.

* * * * *